United States Patent [19]

Ikeda

[11] Patent Number: 5,048,238

[45] Date of Patent: Sep. 17, 1991

[54] NON-CONTACT MACHINING OF SPHERICAL SURFACE

[75] Inventor: Mitsuakira Ikeda, Osaka, Japan

[73] Assignee: Nippon Sheet Glass Co., Ltd., Osaka, Japan

[21] Appl. No.: 550,987

[22] Filed: Jul. 11, 1990

[30] Foreign Application Priority Data

Jul. 11, 1989 [JP] Japan ..... 1-178584

[51] Int. Cl.[5] ..... B24B 11/00; B24B 57/02

[52] U.S. Cl. ..... 51/317; 51/289 S; 51/284 R; 51/292; 51/73 R

[58] Field of Search ..... 51/284 R, 317, 292, 51/73 R, 289 S, 124 L

[56] References Cited

U.S. PATENT DOCUMENTS

| | | | |
|---|---|---|---|
| 1,262,217 | 4/1918 | Leperre | 51/73 |
| 3,218,765 | 11/1965 | Volk | 51/73 |
| 3,882,641 | 5/1975 | Montgomery et al. | 51/317 |

FOREIGN PATENT DOCUMENTS

| | | | |
|---|---|---|---|
| 2822342 | 12/1979 | Fed. Rep. of Germany | 51/124 L |
| 2904349 | 8/1980 | Fed. Rep. of Germany | 51/73 R |
| 0221966 | 9/1988 | Japan | 51/289 S |

OTHER PUBLICATIONS

Morlyama, S., Uchida, F. and Seya, E., "Development of a Precision Diamond Turning Machine for Fabrication of Asymmetric Aspheric Mirrors," Opitcal Engineering, Nov. 1988, vol. 27 No. 11, pp. 1008–1012.

McCue, Howard K., "The Motion Control System for the Large Optics Diamond Turning Machine (LODTM)," Instrument Society of America, Oct. 6, 1981, pp. 163–169.

Donaldson, R. R. and Patterson, S. R., "Design and Construction of a Large, Vertical Axis Diamond Turning Machine," SPIE's 27th Annual International Technical Symposium and Instrument Display Aug. 21–26, 1983, pp. 157–161.

"Influence of Phosphorous Content and Heat Treatment on the Machinability of Electroless Nickel Deposits" by C. K. Syn, J. W. Dini, J. S. Taylor, G. L. Mara, R. R. Vandervoort & R. R. Donaldson.

*Primary Examiner*—Robert A. Rose

*Attorney, Agent, or Firm*—Dickstein, Shapiro & Morin

[57] ABSTRACT

A spherical surface of the workpiece is machined, i.e., abraded or polished, with an abrasive particle layer on a tubular jig. The tubular jig is rotatable about a first axis, and has a through passage extending along the first axis and having a tapered surface on the peripheral edge of an outlet, the tapered surface spreading outwardly. The tubular jig is rotated about the first axis, and a fluid lubricant-coolant containing suspended abrasive particles is supplied into the through passage, so that a highly packed flowing layer of abrasive particles is produced on and along the tapered surface under centrifugal forces generated by the rotation of the tubular jig. Then, the spherical surface of the workpiece, which is rotating about a second axis at a predetermined angle with respect to the first axis, is pressed against the flowing layer of abrasive particles.

13 Claims, 3 Drawing Sheets

NON-CONTACT MACHINING OF SPHERICAL SURFACE

BACKGROUND OF THE INVENTION

1. Field of the Invention

The present invention relates to a method of machining a spherical surface, and more particularly to a non-contact machining method suitable for abrading or polishing a small-diameter lens such as a rod lens.

2. Description of the Relevant Art

Recent efforts to achieve higher performance of small-diameter rod-shaped graded-index glass lenses include machining one end of such a rod lens into a spherical surface.

According to one conventional process for machining one end of a rod lens, a spherical surface is created on the end of the rod lens with a curve generator. The principles of such a curve generator are shown in *Optical Technology Contact,* Vol. 24, No. 10 & No. 12 (1986) and Vol. 25, No. 2 & No. 6 (1987), for example.

The conventional machining process will be described below with reference to FIGS. 6 through 9 of the accompanying drawings. As shown in FIG. 6, a grinding wheel 302 of a large grain size (low grain number) which is mounted on a tip end of a cup 301 is rotated about its own axis, and a rod lens 2 mounted on a blocking tool 24 by an adhesive 23 is positioned such that its axis 22 passes through the center P of a round surface of the grinding wheel 302. Then, the rod lens 2 is pressed against the rotating grinding wheel 302, with a fluid lubricant-coolant supplied from a pipe 303 into the region where the rod lens 2 contacts the grinding wheel 302.

If the lens axis 22 is inclined with respect to the axis 315 of the grinding wheel 302 at an angle of $\beta$, then a spherical surface having a radius of curvature which is indicated by $R=(D/2 \sin \beta)-r$ is generated on the tip end of the rod lens 2, where D is the diameter of the grinding wheel 302 and r is the radius of curvature of the round surface of the grinding wheel 302.

Then, the generated spherical surface of the rod lens 2 is abraded so that the surface is corrected in shape and improved in surface roughness. More specifically, as shown in FIG. 7, an abrading tool 401 comprising a grinding wheel having a concave spherical surface is placed on the spherical surface of the rod lens 2. The lower end of a vertical shaft 402 which is supported on the distal end of an arm 407 (FIG. 8) of a known abrading machine 406 is coupled to the center of an upper surface of the abrading disc 401 by a ball-and-socket joint. The vertical shaft 402 is then laterally oscillated back and forth about the center Q of the concave spherical surface of the abrading disc 401. A fluid lubricant-coolant is supplied from a pipe 403 into the abrading disc 401, and the rod lens 2 is rotated about the axis 22 and pressed against the abrading disc 401 under a prescribed pressure. The spherical surface of the rod lens 2 is thus abraded for surface finishing. Abrading tools of progressively smaller grain sizes (higher grain number) are successively used on the abrading machine 406, so that the spherical surface of the rod lens 2 is corrected in shape and improved in surface roughness through successive abrading steps for finer surface finishes.

Thereafter, the abraded spherical surface of the rod lens 2 is subjected to surface polishing. More specifically, as shown in FIG. 9, a polishing tool 501 having a concave spherical surface with a resilient layer 502 of urethane, tar, or the like applied is placed on the spherical surface of the rod lens 2. The polishing tool 501 and the rod lens 2 are then moved in the same manner as described above, while a fluid lubricant-coolant is being supplied from a pipe 503 into the blocking tool 501. The spherical surface of the rod lens 2 is thus polished.

With the conventional machining process, however, the concave spherical surfaces of the abrading and polishing tools are susceptible to deformations due to mutual lapping. It requires highly skilled hands to remove such deformations from the abrading and polishing tools. Therefore, the quality of finished rod lenses is not assured at a stable level.

The lens abrading process involves a number of successive steps for progressively finer surface finishes. The abrading tools used are designed for a particular radius of curvature of the spherical surface of a rod lens. If a rod lens having a spherical surface with a different radius of curvature is to be abraded, the spherical surfaces of the abrading tools must be corrected. Since the correcting process is tedious and time-consuming and needs a number of steps, the rate of production of rod lenses is low.

SUMMARY OF THE INVENTION

According to the present invention, there is provided a method of machining a spherical surface of a workpiece with a tubular jig which is rotatable about a first axis, a first end, a second end opposite to the first end, and a through passage extending along the axis from the first end to the second end, the passage having an inlet at the first end and an outlet at the second end, the outlet having a tapered surface spreading outwardly at a peripheral edge thereof, the method comprising the steps of rotating the tubular jig about the first axis, rotating the workpiece about a second axis which is inclined a predetermined angle with respect to the first axis, supplying a fluid lubricant-coolant which contains suspended abrasive particles from the inlet through the passage toward the outlet, so that a highly packed flowing layer of abrasive particles is produced on and along the tapered surface under centrifugal forces generated by the rotation of the tubular jig, and pressing the spherical surface of the workpiece against the flowing layer of abrasive particles while the tubular jig and the workpiece are being rotated about the first and second axes, respectively.

The method according to the present invention allows highly accurate machining of a small-diameter lens such as a rod lens, is effective to stabilize the quality of finished workpieces, and can produce abraded or polished workpieces efficiently at a high rate.

More specifically, the flowing layer of abrasive particles is formed on and along the tapered surface of the tubular jig, and the lens is machined, i.e., abraded and polished, with the abrasive particle layer. Therefore, the tubular jig itself is not required to be corrected or replaced, and hence no skilled workers are needed for such correction or replacement. As a result, the quality of machined workpieces is high at stable level. The machined spherical surface is of high quality since it is machined out of contact with the tubular jig. The workpiece can be successively abraded and polished simply by varying the diameter of abrasive particles suspended in the fluid lubricant-coolant, resulting in a concomitant reduction in the number of steps required. Consequently, the efficiency of production of machined workpieces or lenses is increased.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
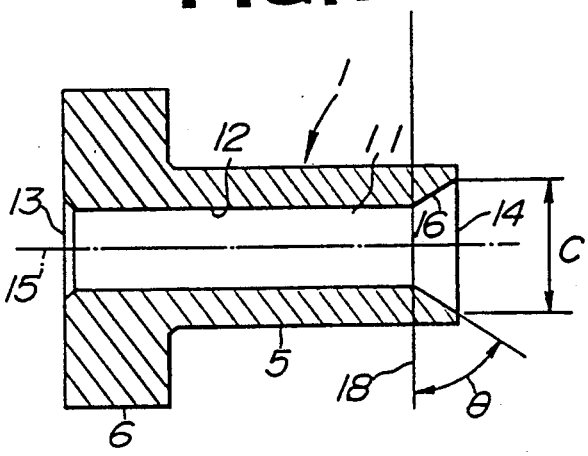
FIG. 1 is a longitudinal cross-sectional view of a tubular lip jig employed in the present invention.

FIG. 1 shows a tubular lip jig 1 which is used in a method of non-contact machining of a spherical surface according to the present invention. The lip jig 1 comprises a tubular portion 5 and a flange 6, and is rotatable about its own axis 15. The lip jig 1 has a fluid lubricant-coolant passage 11 defined therethrough along the axis 15 and extending from an inlet 13 in the rear end on the flange 6 toward an outlet 14 in the front end on the tubular portion 5. The passage 11 is defined by a cylindrical inner wall surface 12 which includes a tapered surface 16 that spreads outwardly at the peripheral edge of the outlet 14. The tapered surface 16 is inclined at an angle of $\theta$ with respect to a plane 18 which lies perpendicularly to the axis 15.

The lip jig 1 can be rotated about the axis 15 by a drive motor (not shown) at a high speed ranging from 5,000 to 10,000 rpm.

Figure 2:
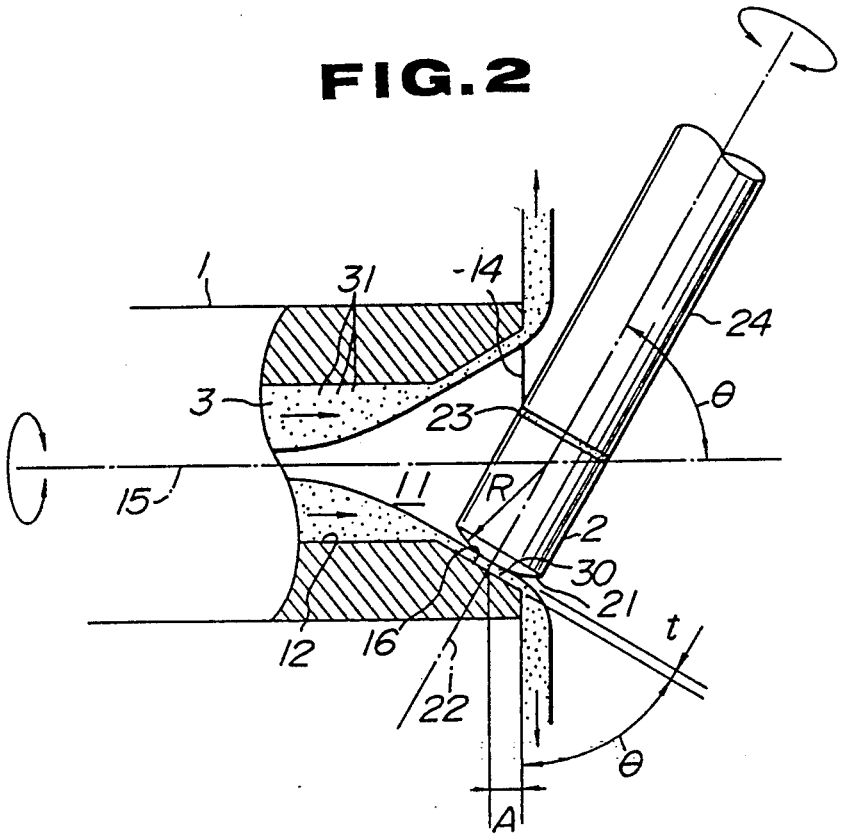
FIG. 2 is an elevational view, partly in cross section, showing the manner in which a rod lens is abraded and polished according to a method of non-contact machining of a spherical surface according to a first embodiment of the present invention.

As shown in FIG. 2, a small-diameter rod-shaped graded-index glass lens 2 which is to be machined, i.e., abraded and polished, is fixedly bonded to the tip of a blocking tool 24 by an adhesive 23. The rod lens 2 is rotated together with the blocking tool 24 about an axis 22 thereof at a relatively low speed of 100 rpm, for example. The axis 22 of the rod lens 2 is inclined at the angle of $\theta$ with respect to the axis 15 about which the lip jig 1 rotates, i.e., extends perpendicularly to the tapered surface 16 of the lip jig 1 in a plane which contains the axes 15, 22.

The method of non-contact machining of a spherical surface according to the present invention will be described with reference to FIG. 2.

The lip jig 1 which has the passage 11 for the fluid lubricant-coolant 3 is rotated about the axis 15 at a high speed in the range of from 5,000 to 10,000 rpm, as described above.

Figure 3:
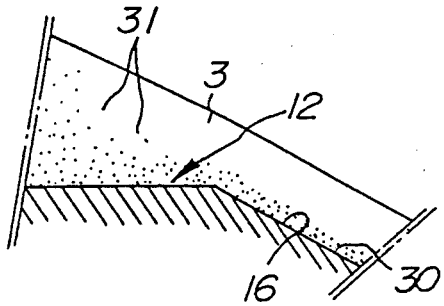
FIG. 3 is an enlarged fragmentary cross-sectional view showing an abrasive particle layer in the process shown in FIG. 2.

Then, the fluid lubricant-coolant 3 which contains suspended abrasive particles 31 is supplied into the passage 11 in the lip jig 1 from the inlet 13 thereof. The fluid lubricant-coolant 3 thus supplied is continuously subjected to rotational energy, depending on the viscosity thereof, which is applied from the lip jig 1 due to the frictional resistance imposed on the fluid lubricant-coolant 3 by the inner wall surface 12 of the lip jig 1. The applied rotational energy, breaks the uniform dispersive distribution of the abrasive particles 31 in the fluid lubricant-coolant 3, thereby causing the suspended abrasive particles 31 to be separated or localized in the fluid lubricant-coolant 3 depending on the mass of the abrasive particles 31. More specifically, those abrasive particles 31 which have a greater mass are subjected to stronger centrifugal forces, and hence are deposited as a layer on and along the inner wall surface 12. The heavier abrasive particles 31 are progressively deposited while the fluid lubricant-coolant 3 is flowing through the passage 12 from the inlet 13 to the outlet 14. Therefore, a highly packed flowing layer 30 of abrasive particles 31 is produced on and along the tapered surface 16 near the outlet 14 as better shown in FIG. 3. Since the abrasive particle layer 30 contains those abrasive particles 31 which have been separated depending on their mass, the diameters of the abrasive particles 31 in the abrasive particle layer 30 are uniformized. A continuous flow of new abrasive particles 31 supplied from the inlet 13 and discharged out of the outlet 14 is also effective to uniformize the particle diameters in the abrasive particle layer 30. The continuous flow of the fluid lubricant-coolant 3 also prevents the machined lens surface from being unduly heated.

Thereafter, a convex spherical end surface 21 of the rod lens 2 is pressed against the abrasive particle layer 30 which is thus formed on the tapered surface 16 of the lip jig 1, with the axis 22 of the rod lens 2 being inclined at the angle of $\theta$ with respect to the axis 15 of the lip jig 1. The rod lens 2 is then rotated about the axis 22 at the speed of 100 rpm, for example.

If it is assumed that the abrasive particle layer 30 is thin and homogeneous, then the surface of the rod lens 2 which is held against the abrasive particle layer 30 is abraded or polished into a spherical surface having a radius of curvature R which is expressed by:

$$R = \frac{1}{2\sin^2\theta}(C\sin\theta - 2A\cos\theta) - t$$

where $\theta$ is the angle of the tapered surface 16 with respect to the plane 18, C is the outside diameter of tapered surface 16, A is the distance from the outer edge of the tapered surface 16 to the position where the rod lens 2 is machined, and t is the thickness of the abrasive particle layer 30.

The non-contact machining method described above is applicable to either abrasion or polishing depending by varying the diameter of the suspended abrasive particles 31 which are mixed in the fluid lubricant-coolant 3.

According to an experiment conducted using the non-contact machining method of the present invention, an end surface 21 of a rod lens 2 which has a maximum surface roughness Hmax ranging from 0.2 to 0.5

μm and an average surface roughness Ha ranging from about 0.03 to 0.05 μm was abraded or polished. The machined surface 21 was observed using a scanning electron microscope at a magnification of ×10,000, but no surface irregularities were visually detected. Therefore, the lens surface was polished to a mirror finish with the maximum surface roughness Hmax of 0.01 μm or less.

The above experiment was carried out under the following conditions: The diameter of the rod lens was 2.0 mm. The lip jig was rotated at the speed of 5,000 rpm. The angle $\theta$ of the tapered surface of the lip jig was 60°. The rod lens rotated at the speed of 100 rpm. The abrasive particles used were particles of zirconium oxide. The fluid lubricant-coolant used was water containing 15 weight % of the abrasive particles. The abrasive particle layer formed on the tapered surface was about 10 μm thick.

With the non-contact machining method as described above, since the tip end 21 of the rod lens 2 is ground, abraded, and polished by the surface layer of the abrasive particle layer 30, the tapered surface 16 of the lip jig 1 is not marked by the rod lens 2. Therefore, the tapered surface 16 is not required to be corrected or the lip jig 1 is not required to be replaced with a new lip jig.

When the distance A from the outer edge of the tapered surface 16 to the machining position is varied, the radius of curvature of the machined surface 21 of the rod lens 2 is varied using the single lip jig 1. Because the rod lens 2 is machined with the suspended abrasive particles 31 and is held out of contact with the lip jig 1 during the machining process, the surface roughness of the machined lens surface 31 is greatly improved.

Further more, inasmuch as the lip jig 1 rotates at high speed, a large amount of machining energy is generated by the lip jig 1 for grinding, abrading, and polishing the rod lens 2 sufficiently. The spherical configuration of the machined lens surface 21 can be corrected and the surface roughness thereof can be improved at the same time, with the result that the rod lens 2 can be machined in a reduced number of processing steps.

Figure 4:
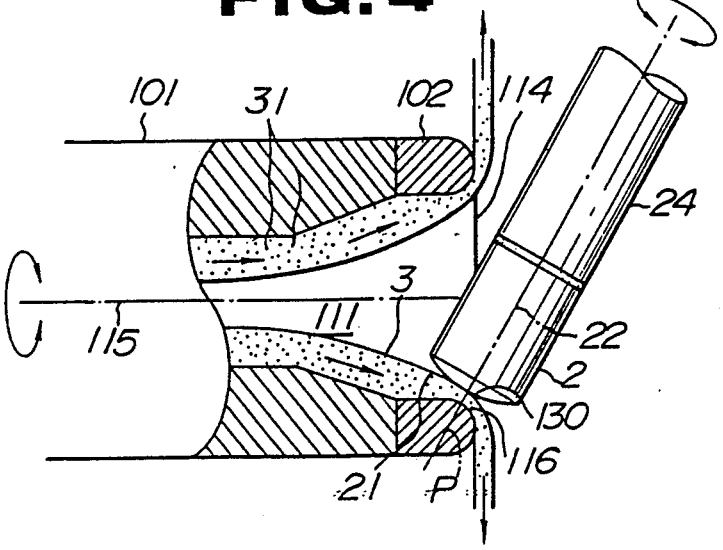
FIG. 4 is a view similar to FIG. 2, showing a method of non-contact machining of a spherical surface according to a second embodiment of the present invention.

FIG. 4 shows a non-contact machining method according to a second embodiment of the present invention. According to the second embodiment, a grinding wheel 102 of a curve generator is attached to the front end of a lip jig 101. After a convex spherical surface has been generated on the tip of a rod lens 2 with the grinding wheel 102, a fluid lubricant-coolant 3 containing suspended abrasive particles 31 is supplied from an inlet (not shown)of a passage 111 toward an outlet 114 of the lip jig 101. During high-speed rotation of the lip jig 101, an abrasive particle layer 130 is formed on an inner surface of the distal end of the grinding wheel 102, and the surface 21 of the rod lens 2 is pressed against the abrasive particle layer 130. The rod lens 2 is positioned such that the axis 22 thereof passes through the center P of curvature of a round surface of the distal end of the grinding wheel 102, the round surface having a hemispherical cross section.

With the second embodiment, after the spherical surface has been formed on the tip of the rod lens 2 with the grinding wheel 102, the fluid lubricant-coolant 3 is introduced into the passage 111 and the abrasive particle layer 130 is formed. Therefore, the rod lens 2 can be abraded and polished immediately after its tip has been ground into a spherical surface.

Figure 5:
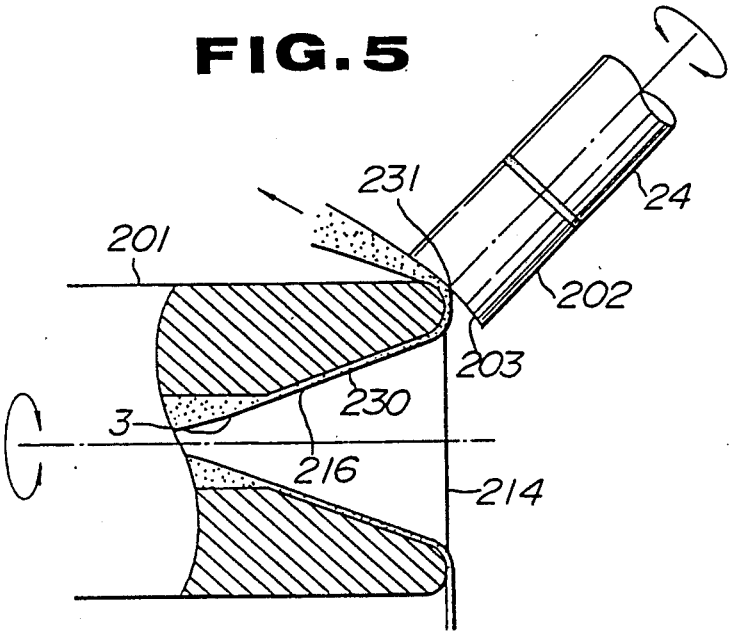
FIG. 5 is a view similar to FIG. 2, showing a method of non-contact machining of a spherical surface according to a third embodiment of the present invention.
Figure 6:
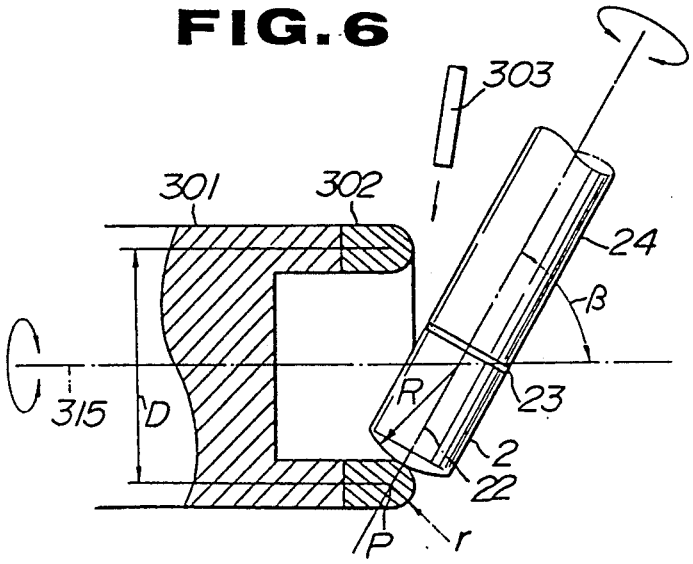
FIG. 6 is a view showing a conventional method of generating a spherical surface with a curve generator.
Figure 7:
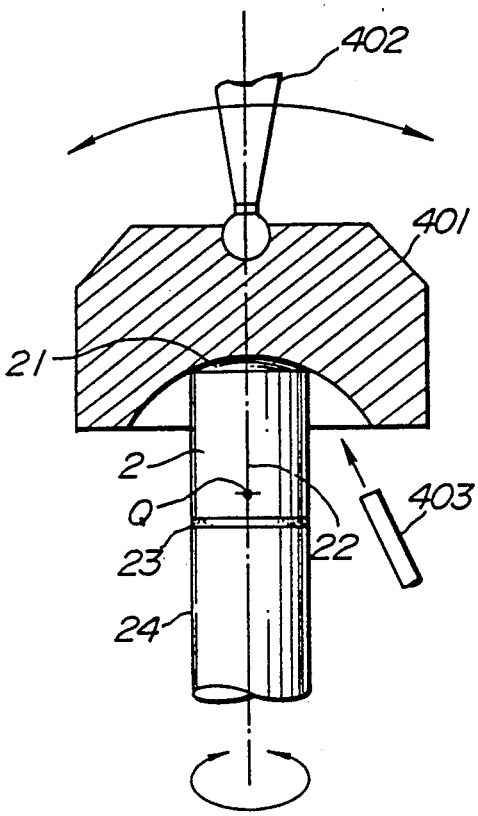
FIG. 7 is a view showing a conventional abrading process.
Figure 9:
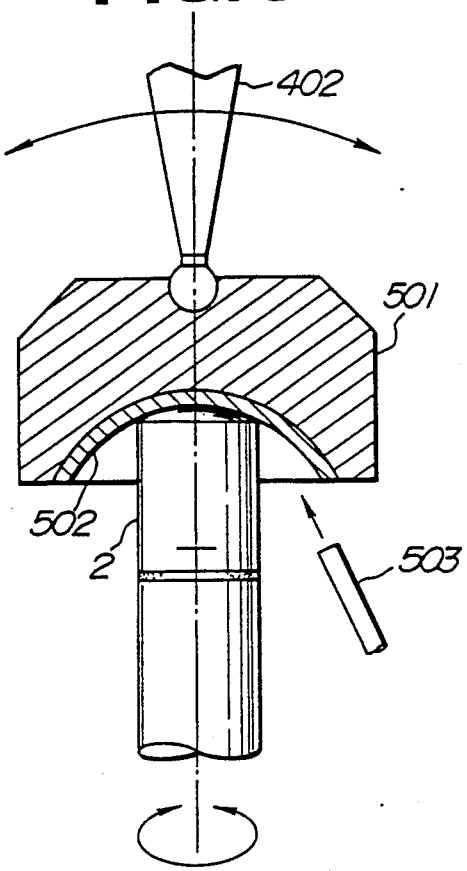
FIG. 9 is a view showing a conventional polishing process.
Figure 8:
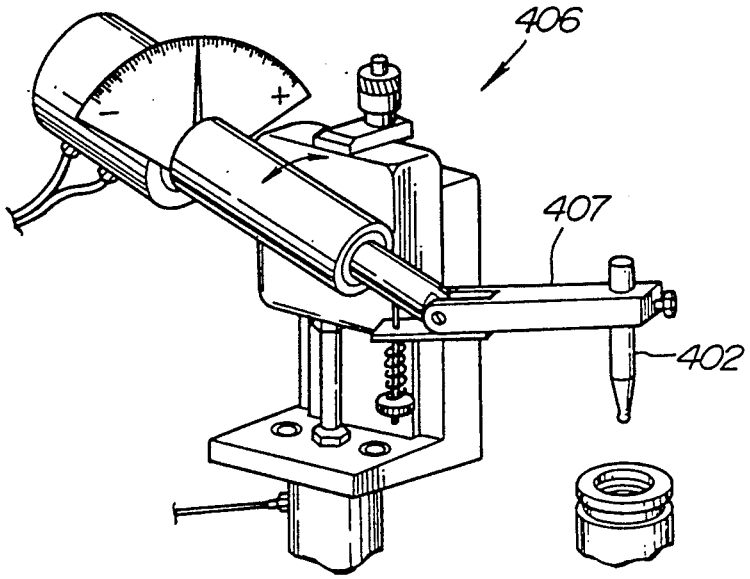
FIG. 8 is a perspective view of a conventional abrading machine.

FIG. 5 illustrates a non-contact machining method in accordance with a third embodiment of the present invention. In the third embodiment, a concave spherical surface 203 of a rod lens 202 is abraded and polished. More specifically, an abrasive particle layer 230 in a lip jig 201 flows from a tapered surface 216 of the lip jig 216 outwardly toward an outlet 214 thereof, and the concave spherical surface 203 of the rod lens 202 is pressed against the abrasive particle layer 231 on the outer end of the outlet 214, so that the concave spherical surface 203 will be abraded and polished.

With the present invention, as described above, a spherical surface of a small-diameter lens such as a rod lens is abraded and polished in a non-contact fashion with an abrasive particle layer. Therefore, the spherical surface is abraded and polished with high accuracy. The quality of spherical lens surfaces thus finished is kept stably at high level, and lenses with finished spherical surfaces can be produced efficiently at a high production rate.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

I claim:

1. A method of machining a spherical surface of a workpiece with a tubular jig which is rotatable about a first axis, a first end, a second end opposite to said first end, and a through passage extending along said axis from said first end to said second end, the passage having an inlet at the first end and an outlet at the second end, the outlet having a tapered surface spreading outwardly at a peripheral edge thereof, said method comprising the steps of:

rotating the tubular jig about said first axis;

rotating the workpiece about a second axis which is inclined a predetermined angle with respect to said first axis;

supplying a fluid lubricant-coolant which contains suspended abrasive particles from said inlet through said passage toward said outlet, so that a highly packed flowing layer of abrasive particles is produced on and along said tapered surface under centrifugal forces generated by the rotation of said tubular jig; and pressing the spherical surface of the workpiece against said flowing layer of abrasive particles while said tubular jig and said workpiece are being rotated about said first and second axis, respectively, wherein said spherical surface of the workpiece has a radius of curvature R which is expressed by:

$$R = \frac{1}{2\sin^2\theta}(C\sin\theta - 2A\cos\theta) - t$$

where $\theta$ is the angle of the tapered surface with respect to a plane which extends perpendicularly to said first axis, C is the outside diameter of the tapered surface, A is the distance from an outer edge of the tapered surface to the position where the workpiece is machined, and t is the thickness of the abrasive particle layer.

2. A method according to claim 1, wherein said predetermined angle is the same as an angle at which said tapered surface is inclined with respect to a plane extending perpendicularly to said first axis.

3. A method according to claim 1, wherein said second axis extends perpendicularly to said tapered surface.

4. A method according to claim 1, wherein said tubular jig rotates at a speed ranging from 5,000 to 10,000 rpm.

5. A method according to claim 1, wherein said workpiece rotates at a speed of about 100 rpm.

6. A method of machining a spherical surface of a workpiece with a tubular jig which has a passage extending along a first axis thereof, said passage having a machining surface at a peripheral edge on an end thereof, said method comprising the steps of:

rotating the tubular jig about said first axis;

rotating the workpiece about a second axis which is inclined a predetermined angle with respect to said first axis;

supplying a fluid lubricant-coolant which contains suspended abrasive particles into said passage so that a highly packed flowing layer of abrasive particles is produced on and along said machining surface under centrifugal forces generated by the rotation of said tubular jig; and pressing the spherical surface of the workpiece against said flowing layer of abrasive particles at one position of said machining surface to keep said end of said passage substantially entirely open while said tubular jig and said workpiece are being rotated about said first and second axes, respectively.

7. A method according to claim 6, wherein said machining surface comprises an inclined surface which progressively spreads outwardly in the radial direction of the tubular jig. said predetermined angle being selected such that said second axis extends perpendicularly to said inclined surface.

8. A method according to claim 6, wherein said machining surface has a hemispherical cross section, said predetermined angle being selected such that said second axis passes through the center of curvature of the hemispherical cross section.

9. A method of machining a spherical surface of a workpiece with a tubular jig which is rotatable about a first axis, a first end, a second end opposite to said first end, and a through passage extending along said axis from said first end to said second end, the passage having an inlet at the first end and an outlet at the second end, the outlet having a tapered surface spreading outwardly at a peripheral edge thereof, said method comprising the steps of:

rotating the tubular jig about said first axis;

rotating the workpiece about a second axis which is inclined a predetermined angle with respect to said first axis;

supplying a fluid lubricant-coolant which contains suspended abrasive particles from said inlet through said passage toward said outlet, so that a highly packed flowing layer of abrasive particles is produced on and along said tapered surface under centrifugal forces generated by the rotation of said tubular jig; and pressing the spherical surface of the workpiece against said flowing layer of abrasive particles at one position of said tapered surface to keep said outlet substantially entirely open while said tubular jig and said workpiece are being rotated about said first and second axes, respectively.

10. A method according to claim 9, wherein said predetermined angle is the same as an angle at which said tapered surface is inclined with respect to a plane extending perpendicularly to said first axis.

11. A method according to claim 9, wherein said second axis extends perpendicularly to said tapered surface.

12. A method according to claim 9, wherein said tubular jig rotates at a speed ranging from 5,000 to 10,000 rpm.

13. A method according to claim 9, wherein said workpiece rotates at a speed of about 100 rpm.

* * * * *